US006976315B2

(12) United States Patent
Hoshiyama

(10) Patent No.: US 6,976,315 B2
(45) Date of Patent: Dec. 20, 2005

(54) APPARATUS FOR ENGRAVING IMAGES AND ITS ADAPTOR

(76) Inventor: Yuichi Hoshiyama, Room 802, 2, Ban 21, Nishi 24-Chome, Kita I-Jo, Chuo-Ku, Sapporo City (JP)

( * ) Notice: Subject to any disclaimer, the term of this patent is extended or adjusted under 35 U.S.C. 154(b) by 0 days.

(21) Appl. No.: 10/900,330

(22) Filed: Jul. 28, 2004

(65) Prior Publication Data

US 2005/0005460 A1 Jan. 13, 2005

Related U.S. Application Data

(63) Continuation of application No. 09/950,178, filed on Sep. 10, 2001.

(30) Foreign Application Priority Data

Sep. 12, 2000 (JP) ..... 2000-318605

(51) Int. Cl.[7] ..... B43L 13/00

(52) U.S. Cl. ..... 33/18.1; 33/18.2; 409/107; 409/88

(58) Field of Search ..... 33/18.1–18.2, 33/32.5, DIG. 2, 1 M, 503; 409/199–200, 204, 206, 107, 165, 88

(56) References Cited

U.S. PATENT DOCUMENTS 3,803,979 A 4/1974 Young
3,925,602 A 12/1975 Doi et al.
3,927,599 A 12/1975 Raymond
5,093,672 A 3/1992 Gascuel et al.
5,232,321 A 8/1993 Suzuki
5,493,965 A 2/1996 Lizarazu
5,504,301 A 4/1996 Eveland
5,512,005 A 4/1996 Gulling
5,569,003 A 10/1996 Goldman et al.
5,594,991 A 1/1997 Therond
5,810,526 A 9/1998 Hirai
6,046,563 A 4/2000 Moreyra

*Primary Examiner*—G. Bradley Bennett
*Assistant Examiner*—Tania Courson
(74) *Attorney, Agent, or Firm*—Wenderoth, Lind & Ponack. L. L. P.

(57) ABSTRACT

An apparatus can be used for engraving images on a passport, credit card, identification card, or the like, and has an adaptor for use in the apparatus. The apparatus includes a personal computer, a controller, a vibration-preventing unit, an X axis pulse motor driver, a Y axis pulse motor driver, an X axis pulse motor, a tilt motor driver, a Z axis head motor having a minute Δ Y axis driver, a stylus and a vacuum pump. Photographs of faces, addresses, names, autographs, the images for engraving information identifying one's identity, the images from a digital camera, scanner or other information taken from a computer through a network can be automatically and correctly engraved on identification cards such as passports, drivers' licenses, employee certificates or credit cards.

6 Claims, 7 Drawing Sheets

APPARATUS FOR ENGRAVING IMAGES AND ITS ADAPTOR

This is a continuation application of Ser. No. 09/950,078, filed Sep. 12, 2001, which is currently pending.

BACKGROUND OF THE INVENTION

1. Field of the Invention

This invention relates to an apparatus for engraving images and its adaptor. More particularly, it relates to an apparatus for engraving images such as photographs of faces, addresses, names, autographs, the images for engraving information identifying one's identity, the images from a digital camera, scanner or other information taken from a computer through a network on identification cards such as passports, drivers' licenses, employee certificates or credit cards, and its adaptor.

2. Description of the Prior Art

There have been proposed various engraving apparatuses (for example, U.S. Pat. No. 5,232,321, Japanese Patent publication Nos. 115676/1989, No. 201762/1988).

According to the conventional apparatus for engraving images on the passports, driver's licenses, employee certificates or credit cards, a magnetic layer is coated on a surface of a plastic card or synthetic paper, and if necessary, a thin colored layer is coated on a surface of the magnetic layer or synthetic paper. A given magnetic picture or image is engraved on the colored layer by a cutting head or a stylus.

When making the passports, driver's licenses, employee certificates or credit cards, the photographs of faces, addresses, names, autographs, the images for engraving information identifying one's identity, etc. are engraved on them together with the position, ID number, etc. in order to increase the security of the engraved cards and to avoid their forgery.

Engraving data source can be roughly classified into image data and text data, which are displayed on a personal computer as independent data, and if necessary, they are combined in the personal computer.

In accordance with the conventional engraving apparatus, independent character data and independent image data are inputted by an independent controller.

In addition, it takes a long time and costs much to develop software and data, and it is also necessary for a user to get used to the method of using the conventional engraving apparatus, thus increasing the burden to the user and making it difficult to transmit, edit and compress the data and causing much confusion and trouble.

The biggest disadvantage of the conventional engraving apparatus is that when making a personal card, it is necessary to make engraving apparatus file data such as a face picture, address, name, or autograph of one person independently and to designate all of the files and to collect and integrate the data.

For the media engraving data such as a face picture, address, name, autograph and the images for engraving information identifying one's identity, etc., there are plastic cards in addition to the magnetic or non-magnetic cards.

There are a lot of kinds of magnetic cards, non-magnetic cards or plastic cards such as standard sized, large-sized, passport size and other sized cards. Accordingly, it is necessary to make a lot of kinds of expensive engraving apparatuses in accordance with these media and their properties. Further, it is likely that vibrations of an engraving head of the conventional engraving apparatus oscillate the engraving apparatus itself to cause incorrect engraving.

SUMMARY OF THE INVENTION

A principal object of this invention is to provide an apparatus for engraving images which comprises a personal computer, a controller, an X-axis pulse motor driver, a Y-axis pulse motor driver, an X-axis pulse motor, a tilt motor driver, a Z-axis head motor having a minute Δ Y-axis driver, a stylus, and a vacuum pump. Photographs of faces, addresses, names, autographs, the images for engraving information identifying one's identity, the images from a digital camera or scanner, or other information taken from a computer through a network can be automatically and correctly engraved on identification cards such as passports, drivers' licenses, employee certificates or credit cards.

Another object of this invention is to provide an apparatus for engraving images whereby a side-by-side comparison of the original image with an engraved image is not required for an operator so that erroneous inputting of information or wrong engraving of another person can be substantially avoided.

Another object of this invention is to provide an apparatus for engraving images comprising a vibration-preventing unit whereby smooth and correct engraving can be easily carried out without causing vibration.

Another object of this invention is to provide an apparatus for engraving images, which is simple in construction so as to facilitate easy assembly, operation and maintenance.

Another object of this invention is to provide an apparatus for engraving images for a passport, identity card and the like, in which various kinds of adaptors are prepared in advance in order to exchange the desired adaptors without having to make various kinds of apparatuses for engraving images.

Another object of this invention is to provide an adaptor for use in an apparatus for engraving images on identification cards, which comprises a rectangular table having a positioning groove and a ridge, both being provided around and near a peripheral edge portion thereof, and a plurality of small air openings provided at the given positions through the table whereby an engraved medium can be sucked and located on the table correctly.

Still another object of this invention is to provide an adaptor for use in an apparatus for engraving images which comprises a first rectangular table and a second rectangular table which is rigidly secured at a given obtuse angle to the first rectangular table. A third rectangular table is pivotally connected to the second rectangular table so that an engraved medium can be sucked and located on the table correctly.

These and other advantages of the invention will become more apparent from the following detailed description thereof when taken in conjunction with the accompanying drawings.

DETAILED DESCRIPTION OF THE PREFFERRED EMBODIMENT

Figure 1:
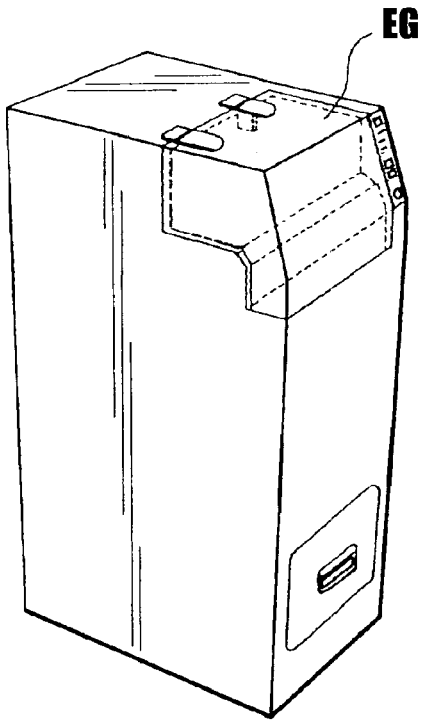
FIG. 1 is a perspective view of an embodiment of an apparatus for engraving images or information identifying one's identity on a passport, or the like of this invention.
Figure 2:
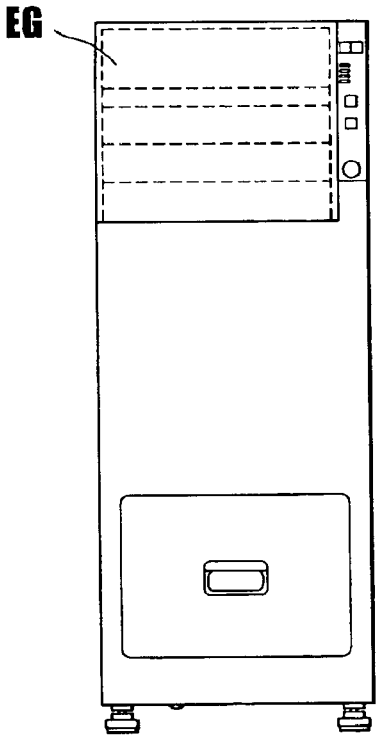
FIG. 2 is a schematic front view of the apparatus for engraving images shown in FIG. 1.
Figure 3:
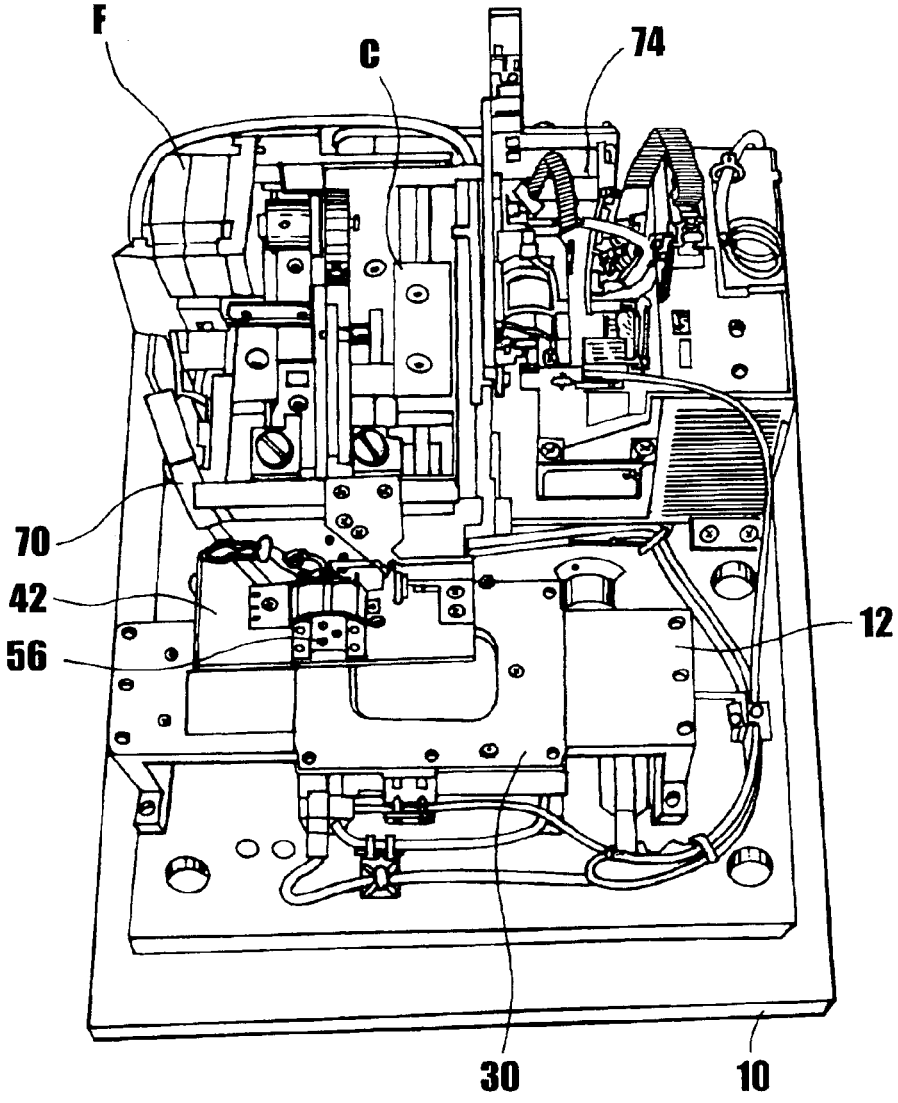
FIG. 3 is an enlarged schematic perspective view of an apparatus for engraving images shown in FIGS. 2 and 3.
Figure 4:
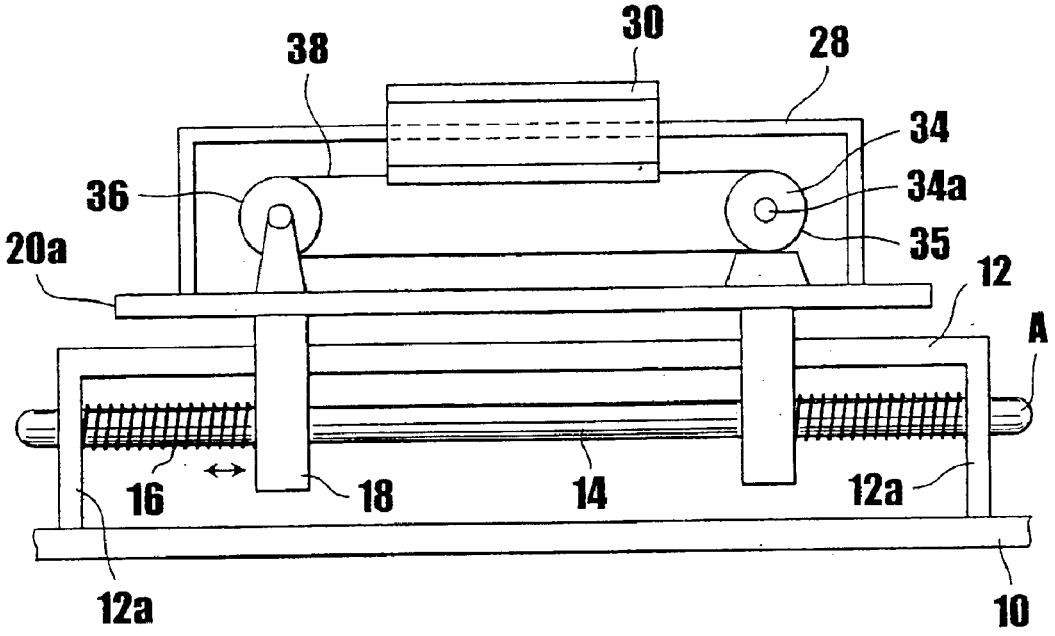
FIG. 4 is an enlarged schematic front view of a driving unit of the apparatus having a vibration-preventing unit and an X-axis feeder shown in FIGS. 2 and 3.
Figure 5:
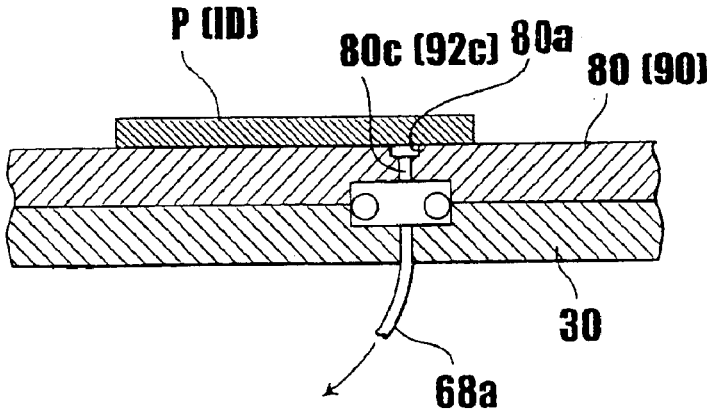
FIG. 5 is an enlarged schematic sectional view showing the sucking relationship between an X-axis feeder, an adaptor and an engraved medium shown in FIG. 4.
Figure 6:
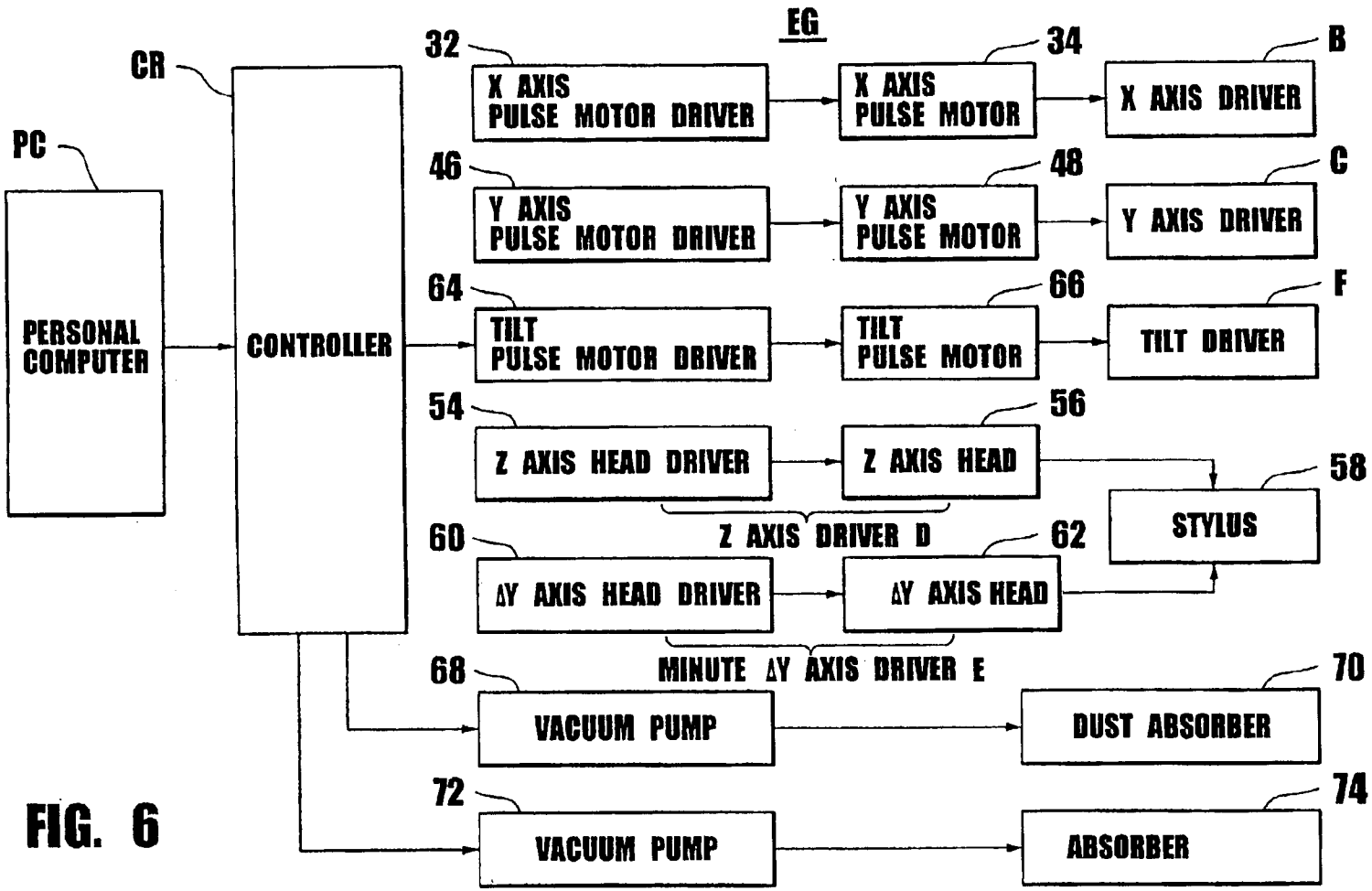
FIG. 6 is a schematic block diagram of an apparatus for engraving images.

Referring to the accompanying drawings in which like numerals designate like parts throughout the several views thereof, this invention will be explained with respect to an example in which an apparatus EG for engraving images is connected to a personal computer PC.

As particularly shown in FIGS. 2–6, the apparatus EG comprises a base plate 10 having a given thickness and width, on which a U-shaped (inverted) driving stand 12 having a pair of legs 12*a*, 12*a* is rigidly mounted.

An opening (not shown) is provided through a central portion of each leg 12*a*, and a pair of bearings 18, 18, each having an opening (not shown), are made independently.

Both end portions of a spindle 14 penetrate through the openings of the bearings 18, 18 and the openings of the legs 12*a*, 12*a* with a pair of coil springs 16, 16, each being located between a leg 12*a* and a bearing 18, respectively.

It should be appreciated that the spindle 14 is mounted to extend horizontally and parallel to the base plate 10 to form a vibration-preventing unit A.

A second base plate 20*a* is integrally mounted on the top of each of the bearings 18, 18, a pair of driving and driven pulleys 36 and 34 are provided on a pair of blocks mounted on the second base plate 20*a*, a timing belt 38 is engaged on these pulleys 36 and 34, an X-axis feeder 30 is provided on the timing belt 38 and a U-shaped rail 28, and an X-axis pulse motor driver 32 and an X-axis pulse motor 34 are connected to the X-axis feeder 30.

A Y-axis driver C connected to the controller CR of the engraving apparatus EG comprises a Y-axis pulse motor driver 46 and an Y-axis pulse motor 48.

A Z-axis driver D is provided on a head base, which is a top portion of the Y-axis driver C.

The Z-axis driver D comprises a Z-axis head driver 54, a Z-axis head 56, a stylus 58 provided at a lower portion of the Z-axis head 56, and a minute Δ Y-axis driver E having a Δ Y-axis driver 60 and a Δ Y-axis head 62 connected to the stylus 58.

A tilt driver F which is connected to the controller CR comprises a tilt pulse motor driver 64 and a tilt pulse motor 66 which is provided at a front portion of the Y-axis driver C so that when an adaptor 80 is tilted rearwards, an engraved media such as a passport P or an identification card ID can be easily placed on the adaptor 80.

Mounted on the adaptor 80 and near the X-axis pulse motor 34 is a vacuum pump 68, and an air hose 68*a* having a small diameter which is mounted near the X-axis pulse motor 34 to work as a dust absorber 74 of the engraved cut dust or scrap.

As shown in FIGS. 5–8, an adaptor 80 includes a rectangular table having a given thickness and width, and it can be put on the X-axis feeder 30.

Figure 7:
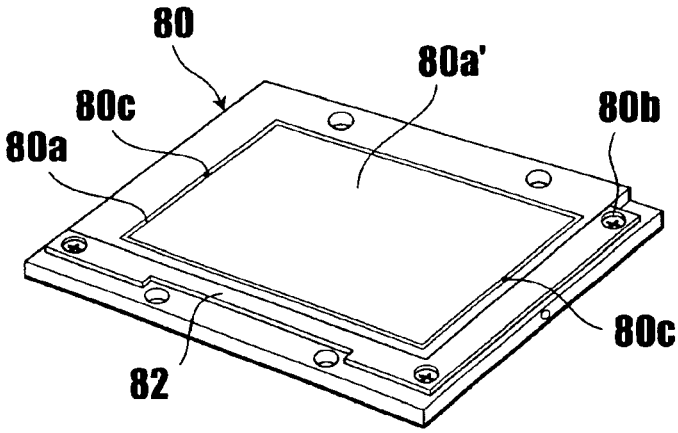
FIG. 7 is a schematic front perspective view of an adaptor of the present invention.
Figure 8:
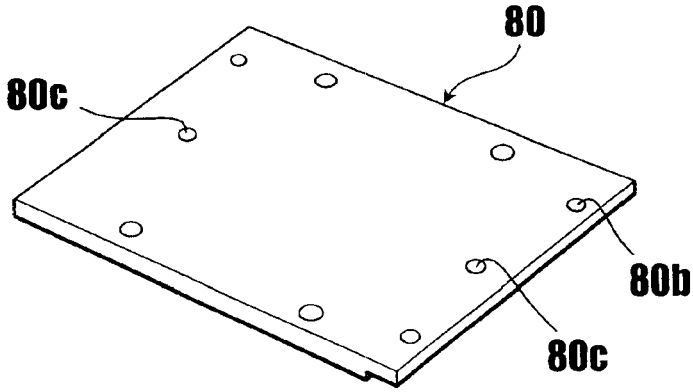
FIG. 8 is a schematic perspective view of the adaptor shown in FIG. 7, seen from a backside.

As particularly shown in FIGS. 7 and 8, another end portion of the air hose 68*a* is put into the air opening 80*c* from a backside of the positioning rectangular groove 80*a* provided near an outer periphery of the adaptor 80. A rectangular planar surface 80*a*′ which is defined by the rectangular groove 80*a* is dented slightly for about 0.1 mm, and a pair of small air openings 80*c*, 80*c* are provided through the adaptor 80 at the upper and lower grooves 80*a*, 80*a*. Therefore, absorbing air from the backside of adaptor 80 can hold the media such as an identification card ID on the rectangular dented planar surface 80*a*′.

Figure 9:
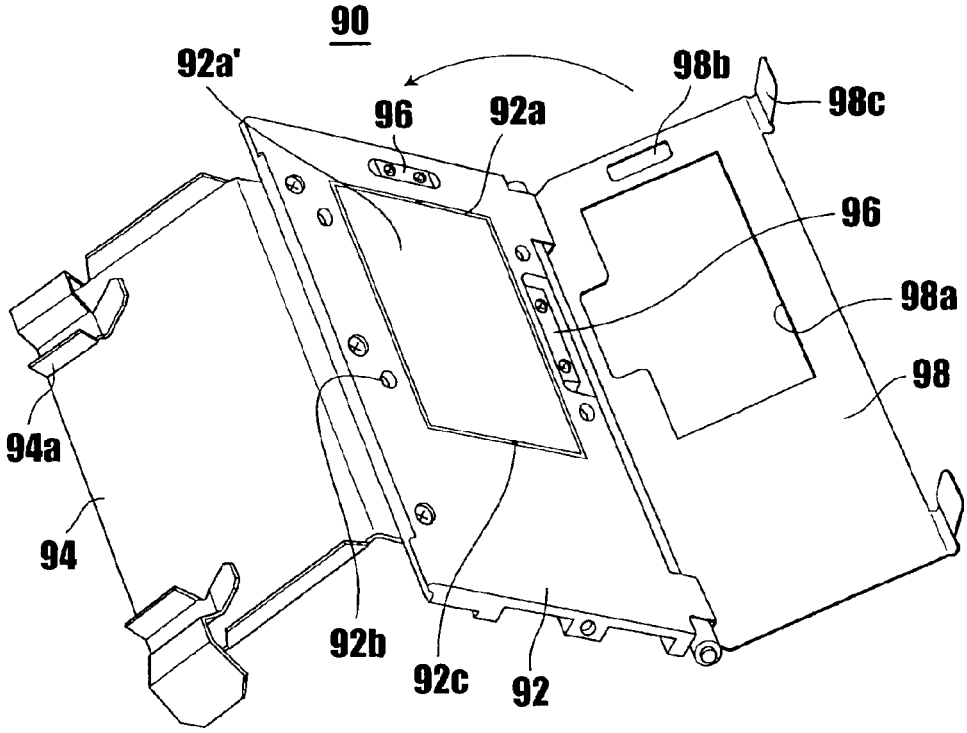
FIG. 9 is a schematic perspective view of another adaptor of the present invention, showing that a third rectangular table is pivotally opened from the second rectangular table.
Figure 10:
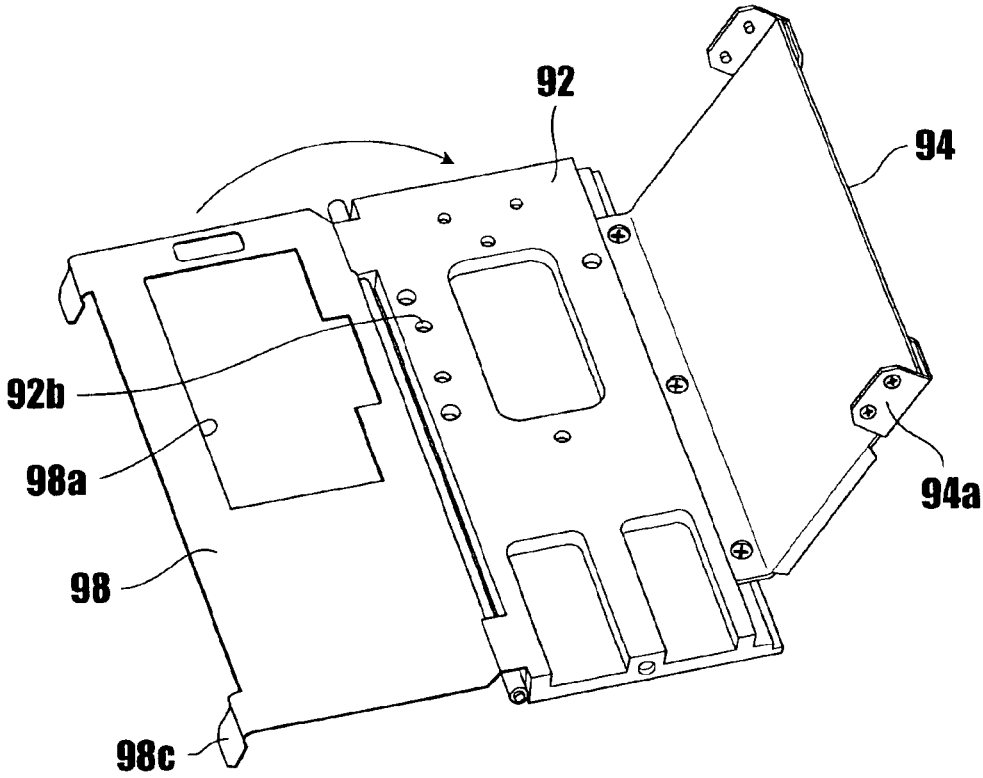
FIG. 10 is a schematic perspective view of the adaptor shown in FIG. 9, seen from a backside.
Figure 11:
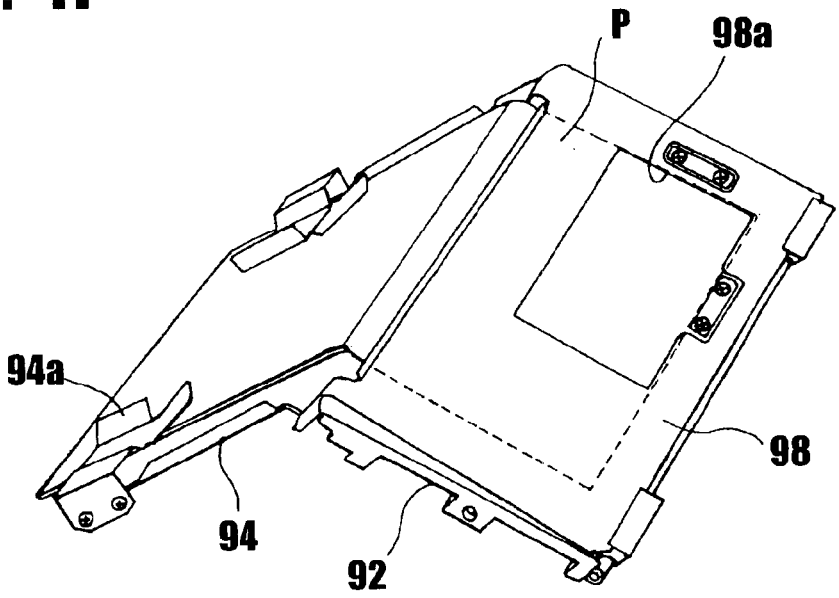
FIG. 11 is a schematic perspective view showing a passport held between the second and third rectangular tables.

An adaptor 90 for engraving images on a passport P is shown in FIGS. 9–11, in which the adaptor 90 has a holding table 92, an inclined table 94 which is rigidly secured to a first edge portion of the holding table 92, and a lid plate 98 which is pivotally secured to a second edge portion of the holding table 92.

More particularly, the holding table 92 has a given thickness and width, a rectangular planar surface 92*a*′ which is defined by the rectangular groove 92*a* is dented slightly for about 0.1 mm, and a pair of small air openings 92*c*, 92*c* are provided through the adaptor 90 at the upper and lower grooves 92*a*, 92*a*. Therefore, absorbing air from the backside of adaptor 90 can hold the engraved passport P on the rectangular dent portion 92*a*′.

In addition, a pair of positioning ridges 96, 96 are provided on top and side portions of the holding table 92, and a rectangular window 98*a* is provided through the lid plate 98 in order to correspond with the rectangular dented planar surface 90*a*′.

A pair of clips 94*a*, 94*a* are provided at both corner portions of the inclined table 94, and a pair of grips 98*c*, 98*c* are mounted at both upper and lower portions of an outer edge portion of the lid plate 98 so that the engraved passport P may be correctly held between the holding table 92 and the lid plate 98 and smooth engraving can be easily carried out without causing vibration.

As explained in the foregoing paragraphs and as particularly shown in FIGS. 7–11, the rectangular planar surface 80*a*′, which is defined by the rectangular groove 80*a*, is dented slightly for about 0.1 mm. The pair of small air openings 80*c*, 80*c* are provided through the adaptor 80 at the upper and lower grooves 80*a*, 80*a* so that the media such as an identification card ID can be easily positioned on the rectangular dented planar surface 80*a*′ and held on the adaptor 80 by a negative air pressure.

It should be appreciated that a suction pump, a pressure sensor, an electromagnetic valve and piping (not shown) are connected to the air hose 68*a*.

Like the example of the adaptor 80, the adaptor 90 for engraving images on a passport P comprises the rectangular planar surface 92*a*′ which is defined by the rectangular groove 92*a* and is dented slightly for about 0.1 mm, and a pair of small air openings 92*c*, 92*c* are provided through the adaptor 90 at the upper and lower grooves 92*a*, 92*a* so that the engraved passport P can be disposed on the rectangular dent portion 92*a*′ to allow a correct and smooth engraving of the engraved passport P.

MODE OF OPERATION

The apparatus EG for engraving images on a passport, identification card, or the like is connected to the personal computer PC, an engraved media such as a magnetic card is manually put on the adaptor 80 (or 90), which is mounted on the X-axis feeder 30, onto which images such as a picture of a face, a name, an autograph, information identifying one's identity, etc., or other information data taken from a digital camera, scanner, or other computers through a network are transmitted by an image signal from the controller CR to cause the stylus 58 to be reciprocated rapidly right and left (in a direction of the X-axis), back and forth (in a direction of the Y-axis) and up and down (in a direction of the Z-axis) to engrave the desired images on the media such as a passport, identification card, or the like to a converted depth.

Other modifications can be made to this invention by those skilled in the art without departing from the scope thereof. While several forms of the invention have been illustrated and described, it will also be apparent that various modifications can be made without departing from the spirit and scope of the invention. Accordingly, it is not intended that the invention be limited, except as by the appended claims.

What I claim is:

1. An apparatus for engraving images, comprising:

a controller connected to a personal computer;

a first base plate;

a U-shaped driving stand mounted on said first base plate, said driving stand having a pair of legs each having an opening formed therethrough;

a pair of bearings each having an opening formed therethrough;

a spindle extending through said opening in each of said legs and through said opening in each of said bearings so as to be arranged parallel to said first base plate, each of said bearings being slidably mounted to said spindle so as to be capable of reciprocating along said spindle;

a pair of coil springs, each coil spring being located between one of said legs and a corresponding one of said bearings;

a second base plate integrally mounted to a top portion of each of said bearings;

a driving pulley mounted on a first block on said second base plate;

a driven pulley mounted on a second block on said second base plate;

a timing belt engaged with said driving pulley and said driven pulley;

a U-shaped driving rail mounted on said second base plate;

an X-axis feeder mounted to said timing belt and said U-shaped driving rail;

an X-axis pulse motor driver and an X-axis pulse motor connected to said X-axis feeder so as to drive said X-axis feeder;

a Y-axis driver connected to said controller and having a top portion comprising a head base, said Y-axis driver including an interconnected Y-axis pulse motor driver and a Y-axis pulse motor;

a Z-axis driver mounted to said head base of said Y-axis driver, said Z-axis driver including a Z-axis head driver and a Z-axis head;

a stylus mounted to said Z-axis head;

a Δ Y-axis driver including a Δ Y-axis head driver and a Δ Y-axis head connected to said stylus; and a tilt driver including a tilt pulse motor driver and a tilt pulse motor arranged at said Y-axis driver so as to tilt an adaptor to be mounted to said X-axis feeder.

2. The apparatus of claim 1, further comprising an adaptor including:

a rectangular table mounted to said X-axis feeder, said rectangular table having a rectangular positioning groove defining a rectangular planar surface, and having a pair of air openings extending through said rectangular table at said positioning groove; and an air hose connected to a backside of said rectangular table, a first end of said air hose being attached to a rear side of one of said air openings, and a second end of said air hose being attached to a vacuum pump.

3. The apparatus of claim 2, wherein said rectangular planar surface of said rectangular table is slightly dented to depth of about 0.1 mm.

4. The apparatus of claim 1, further comprising an adaptor including:

a holding table having a rectangular positioning groove defining a rectangular planar surface, having a pair of air openings extending through said rectangular table at said positioning groove, and having a pair of positioning ridges at a top portion and a side portion, respectively, of said holding table;

an inclined table rigidly secured to a first edge of said holding table, said inclined table having a pair of clips at respective corner portions thereof;

a lid plate pivotally connected to a second edge of said holding table, said lid plate having a rectangular window therethrough and arranged to correspond to said rectangular planar surface of said holding table, and having a pair of grips at an upper portion and a lower portion, respectively, of an outer edge thereof for holding said lid plate against said holding table.

5. The apparatus of claim 4, wherein said adaptor further includes an air hose connected to a backside of said holding table, a first end of said air hose being attached to a rear side of one said air openings, and a second end of said air hose being attached to a vacuum pump.

6. The apparatus of claim 4, wherein said rectangular planar surface of said holding table is slightly dented to depth of about 0.1 mm.

* * * * *